United States Patent [19]

Robinson

[11] 4,093,187

[45] June 6, 1978

[54] FENCING STAY SYSTEM

[76] Inventor: Charles Elbert Robinson, Livermore, Colo. 80536

[21] Appl. No.: 643,074

[22] Filed: Dec. 22, 1975

[51] Int. Cl.[2] ..... E04H 17/10

[52] U.S. Cl. ..... 256/49; 403/363

[58] Field of Search ..... 256/48, 49, 52, 54, 256/DIG. 3, DIG. 5; 403/363

[56] References Cited

U.S. PATENT DOCUMENTS

| | | | |
|---|---|---|---|
| 319,277 | 6/1885 | Lesher | 256/DIG. 5 |
| 394,602 | 12/1888 | Orr | 256/48 |
| 717,923 | 1/1903 | Rapp | 256/54 |
| 957,619 | 5/1910 | Melish | 256/49 |

FOREIGN PATENT DOCUMENTS

| | | | |
|---|---|---|---|
| 221,324 | 5/1959 | Australia | 256/54 |

*Primary Examiner*—Andrew V. Kundrat
*Attorney, Agent, or Firm*—Burton & Dorr

[57] ABSTRACT

A system for temporary or permanent fence construction and repair is disclosed having a plurality of modular building components for constructing rail fences, for repairing existing fences, for placing signs and protective guards on existing fences, for constructing cattle guards and for other similar uses. The disclosed fencing stay system is an improvement in the art in that a universal modular system is proposed that is adoptable to a plurality of uses. The disclosed fencing stay system comprises a variety of anchors each commonly being capable of engaging a variety of longitudinal stays. The anchors are designed to affix to a plurality of barrier surfaces and the stays are designed to provide support for the system. The mating surfaces between any of the stays and any of the anchors is identical. Each stay is further designed to be substantially triangular in cross-section with horizontal flange ends containing inwardly directed channels while each anchor is designed to have a cross-section containing a raised mid-portion and lower opposing horizontal flange edges for slideably engaging the corresponding channels of the stay.

1 Claim, 35 Drawing Figures

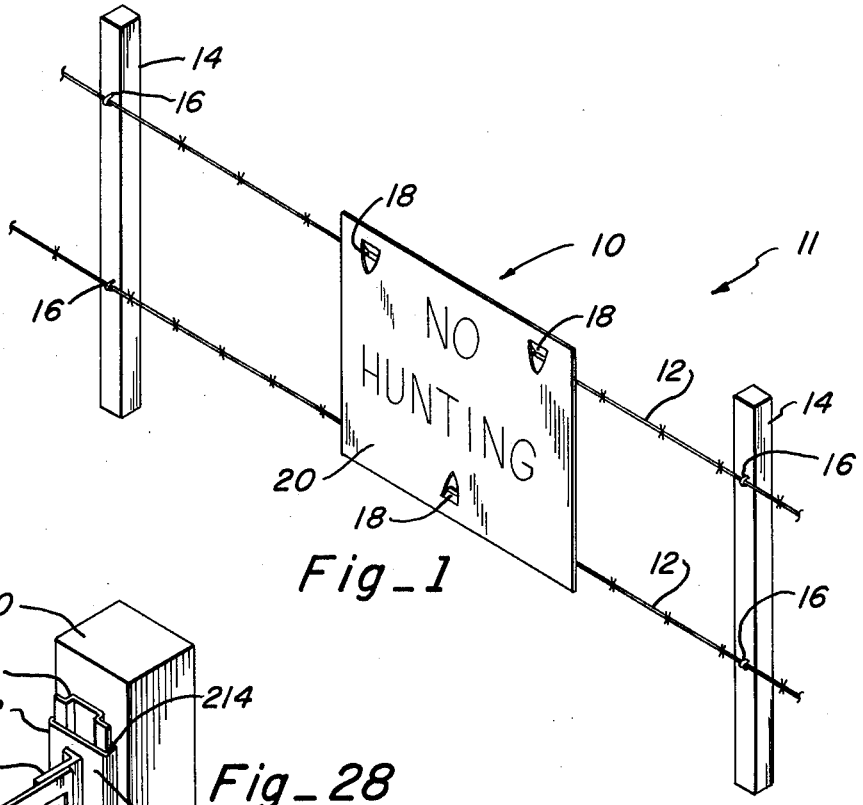
Fig_1
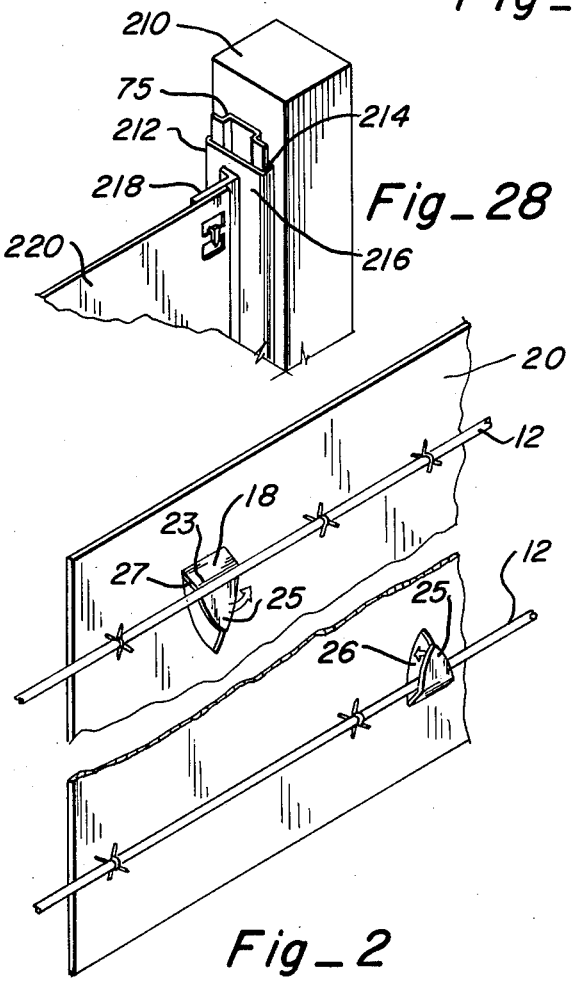
Fig_28
Fig_2
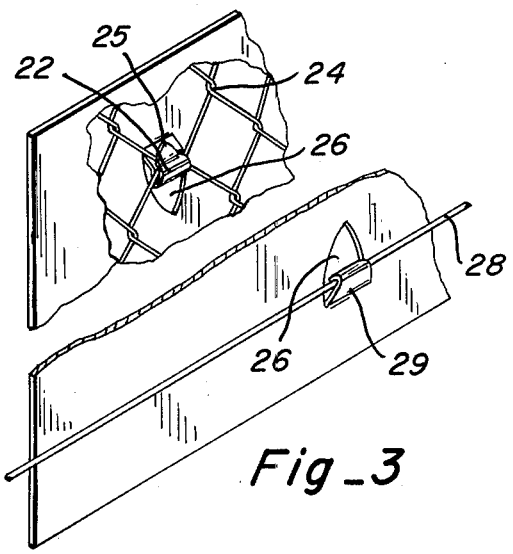
Fig_3

174
172
36
86
52
170
171
79
181
180
106
80
107
176
178

FENCING STAY SYSTEM

BACKGROUND OF THE INVENTION

1. Field of the Invention

This invention relates to fencing systems and, in particular, to fencing systems constructed out of modular components.

2. Description of the Prior Art

It is common practice to construct fences of various types and configurations based on readily available component parts. For example, a typical conventional fence may comprise a plurality of wood posts spaced at periodic intervals interconnected by three or four strands of wire barrier wherein the wire is affixed to the wooden post by a staple or the like. Often, such a conventional fence, after a period of time and exposure to the elements, is plagued with the following problems: sagging of the wires between posts, leaning or tipping posts, loss of staples affixing the wire to the post, and so forth. In addition, it is often desirable to add a fourth or a fifth strand of wire at a distance above the existing wire fence due to drifting sand or dirt which often entails removing the existing fence and constructing a new and higher fence.

Another conventional fence system is that commonly employed for electrical wire barriers which include a series of spaced metal posts carrying electric wire separated from and connectable to the post via a porcelain insulator. These fences are usually more portable than the above described wire-wood fence and may be easily constructed and easily removed. Yet, such a system requires the user to purchase fencing components completely unlike that of the above described system.

A further conventional fencing system is the metal post system which usually requires wire clips or the like to fasten the various types of wire barrier to the post.

Yet still another type of conventional fencing system embraces that commonly referred to as a rail fence. Such a fence utilizes metal rails that are bolted onto a wooden post and comprises six or seven rails in height. Such rail fencing systems require components unique and different from the above-described systems.

Although such prior art arrangements operate satisfactorily to provide fencing, they require wholesalers and retailers to stockpile a variety of component parts and, as the case often is, it further requires the purchaser-user to purchase and stockpile a supply of a variety of replacement and repair parts.

The Inventor, prior to applying for this Letters Patent, caused a patent search to be conducted with the resulting patents being discovered:

| Inventor | Patent No. | Date |
|---|---|---|
| Jory | 340,788 | April 27, 1886 |
| Wilson | 515,945 | March 6, 1894 |
| Ferguson, et al | 580,682 | April 13, 1897 |
| Goldberg | 652,101 | June 19, 1900 |
| Haas | 786,025 | March 28, 1905 |
| Smith | 1,116,942 | Nov. 10, 1914 |
| Bindhammer | 1,163,638 | Dec. 14, 1915 |
| Shipps | 1,618,312 | Feb. 22, 1927 |
| Schneider | 2,902,786 | Sept. 8, 1959 |
| Hopp, et al | 3,029,537 | April 17, 1962 |

Despite the frequency and prevalence of the above systems none of the above systems are easily adaptable for cattle guard construction, sign erection, and other farm and industrial uses.

BRIEF SUMMARY OF THE INVENTION

It is, therefore, an object of the invention to provide a novel fencing system which utilizes modular components for a variety of purposes.

It is a further object of the present invention to provide a temporary or permanent fencing system that is adaptable to repair and maintain prior art fencing systems with a minimum of cost and complexity and with a maximum of flexibility.

It is a further object of this invention to provide a modular fencing system that is adaptable to repair existing prior art fences, to construct new fences, to erect signs, and to construct cattle guards.

It is a further object of this invention to provide a modular fencing system having a plurality of anchors being capable of attaching a variety of barrier surfaces.

It is a further object of this invention to provide a modular fencing system having a plurality of stays being capable of providing support for a variety of barriers.

It is a further object of this invention to provide an extender being capable of coupling stays together and providing support therefor.

It is a further object of this invention to provide a modular fencing system having a plurality of modular anchors being capable of attaching to a variety of barrier surfaces and a plurality of stays being capable of providing support for a variety of barriers wherein each anchor is connectable to each stay over a common mating surface.

It is still a further object of the present invention to provide an anchor of a raised mid-section having means disposed thereon for connecting to a fence barrier and further having lower horizontal flange edges on each side of said mid-section.

It is a further object of this invention to provide a stay of triangular cross-section with opposing horizontal flanges containing open inwardly directed channels.

It is a further object of this invention to provide an extender of triangular cross-section with opposing horizontal flat flange edges.

It is a further object of this invention to provide a modular fencing system having a plurality of modular anchors being capable of attaching to a variety of barriers and a plurality of stays being capable of providing support for a variety of barriers wherein each stay is of a triangular cross-section with horizontal flange edges containing inwardly directed channels and with each anchor having a cross-section comprising a raised mid-section with opposing lower horizontal flange edges for slideably engaging the channels of the stay.

It is a further object of this invention to provide a modular fencing system having a plurality of different anchors having means for connecting to a variety of barriers, a plurality of different stays for providing support for the anchors, and a plurality of extenders for interconnecting the stays and for support thereof, said anchors having a raised mid-section containing said connecting means and parallel opposing horizontal side flanges, said stays being of triangular cross-section having opposing inwardly directed horizontal channels, and said extenders being of triangular cross-section having parallel opposing horizontal side flanges.

It is a further object of the present invention to provide an apparatus for repairing snow fences.

It is a further object of the present invention to provide an apparatus for repairing snow fences comprising a plurality of anchors having a cross-section of a raised horizontal mid-section with a clip for attaching to the wire barriers of the snow fence and of opposing lower horizontal flange edges and said apparatus further comprising a stay having triangular cross-section with opposing horizontal flanges containing open inwardly directed channels, said channels for slideably engaging the flange edges of the anchors.

It is a further object of the present invention to provide an apparatus for extending the height of an existing fence and to provide a barricade therefor.

It is a further object of the present invention to provide an apparatus for extending a fence's height comprising a plurality of anchors having a cross-section of raised horizontal mid-section with means for attaching to the barriers and posts of the existing fence and to said additional barriers and further having horizontal flange edges disposed on opposing sides of the mid-section, and a plurality of stays slideably engaging the anchors, said stays having a triangular cross-section with opposing horizontal flanges containing open inwardly directed channels receptive of said anchor flange edges.

SUMMARY DESCRIPTION

Conventional fencing systems are plagued with numerous problems due primarily to adverse environmental elements and further due to continued heavy use thereof. Major problems include sagging or loose wire barriers usually found at the mid-section between two posts and leaning or tilting support posts. In addition, such fences are usually not expandable since, once constructed to handle either three or four strands or wire barrier, additional strands cannot be added above the support fence posts. In such a situation, the expensive process of removing the existing fence and constructing a new fence must be done. Or, if it is desired to superimpose one fencing system over another fencing system, as for example superimposing a chicken wire barrier over a barb wire barrier on a temporary basis it becomes quite difficult and is destructive to the existing fencing system once removal of the temporary barrier is desired.

The fencing system of the present invention is primarily designed for repairing and maintaining existing fencing systems of all types and for constructing new fences and which utilizes common modular units that are arranged to be quickly installed either on a permanent or temporary basis.

The disclosed invention comprises a plurality of anchors for attachment of a variety of barrier surfaces, each of the anchors having identical mating surfaces over which slides any of a plurality of universal longitudinal stays, each of which is of rigid triangular cross-section having opposing horizontal flanges with inwardly directed channels receptive of said mating surfaces. For example, one type of disclosed anchor can be readily affixed to a barbed wire strand. Therefore, the present invention can readily repair a barbed wire fence that sags in the following manner. Anchors can be readily attached to each strand of barbed wire barrier in vertical alignment so that a longitudinal stay is vertically slid over the mating surface of each anchor and affixed thereto so that the sagging fence is held in a non-sagging position. Other anchor configurations include those adapted to be nailed to a wooden post, to be anchored to another anchor, or to carry a porcelain insulator and the like. Each anchor, however, contains a raised mid-section having lower horizontal flange edges on opposing sides for slideably engaging the corresponding inwardly directed channels directed of the stay.

In accordance with the present invention, a universal fencing system comprising modular anchors and stays adopted for different uses and purposes but interconnecting in a universal fashion are provided to repair and support existing fencing systems and to comprise a new means for building rail fences, cattle guards, erecting barricades and signs and so forth.

DRAWING

These and other objects of the present invention will become more apparent upon a reading of the following description thereof taken in conjunction with the drawing in which:

FIG. 1 pictorially discloses a sign using the clip of the present invention disposed between two wire barriers of a conventional fencing system;

FIG. 2 pictorially illustrates two approaches in affixing the clips of the present invention to different wire barriers.

FIG. 3 pictorially shows the clips of FIG. 1 being clamped to chicken wire and to bare strand wire according to the two approaches of FIG. 2.

Figures 18, 19, 20, 21:
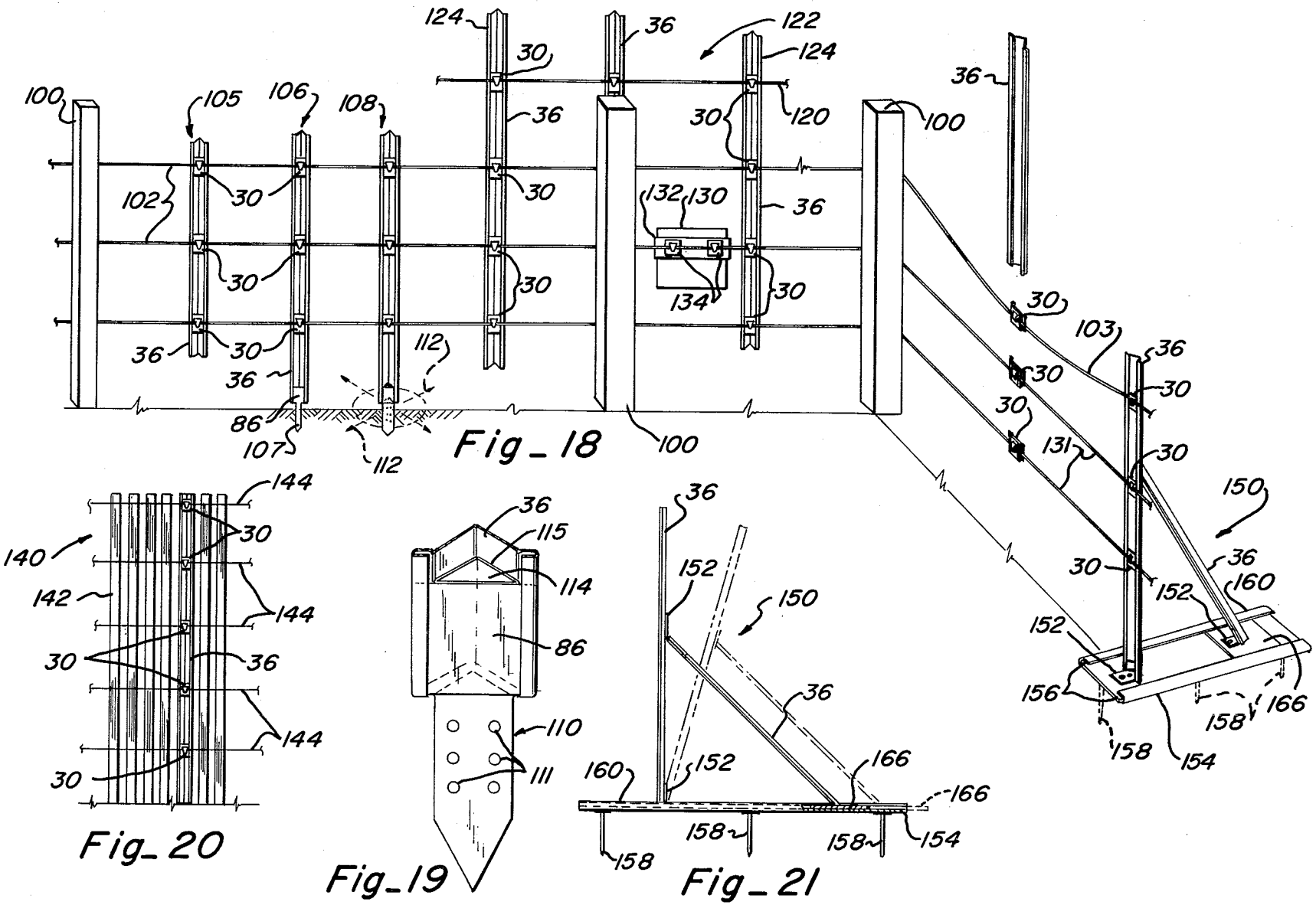
Figures 22, 23, 24, 25:
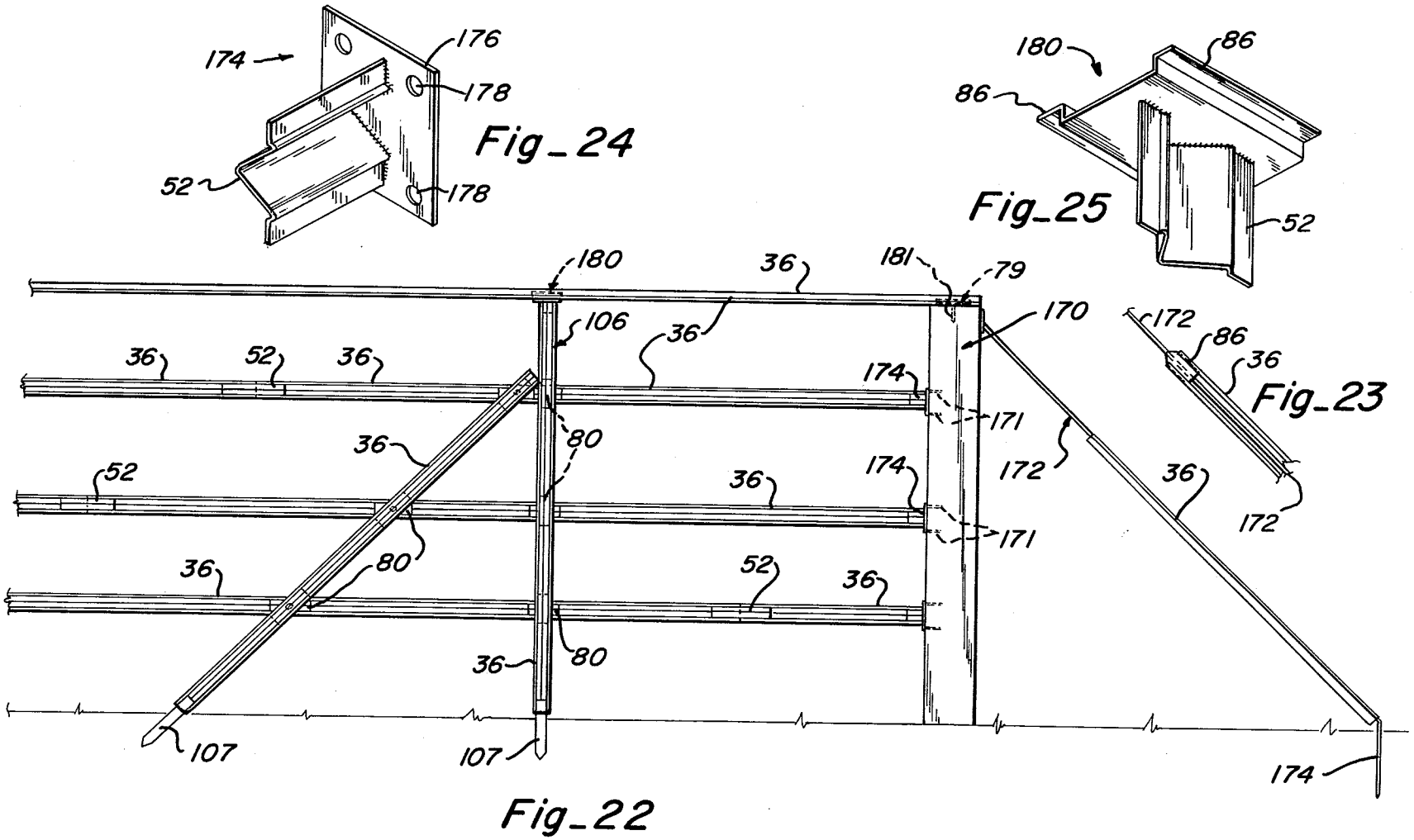
Figure 27:
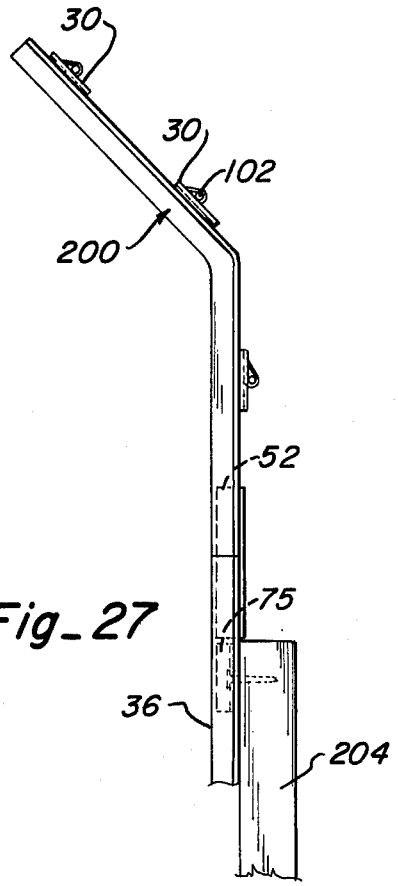
Figure 26:
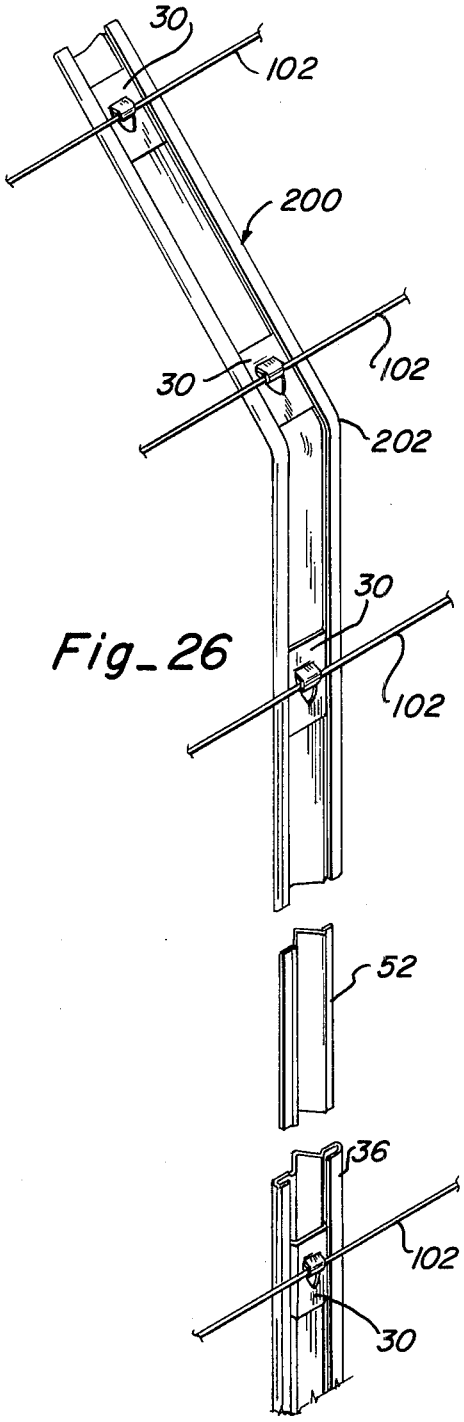
Figure 29:
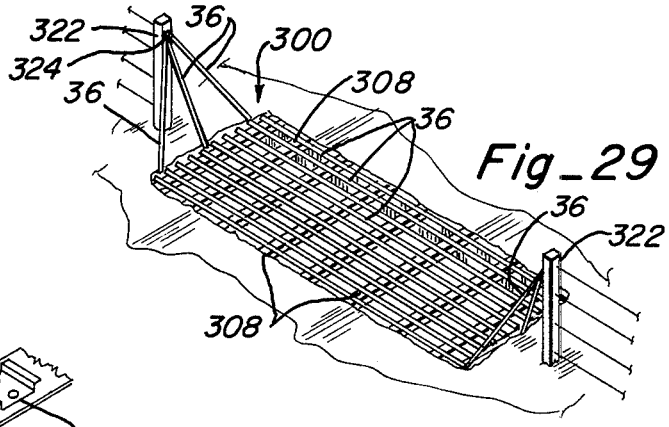
Figure 30:
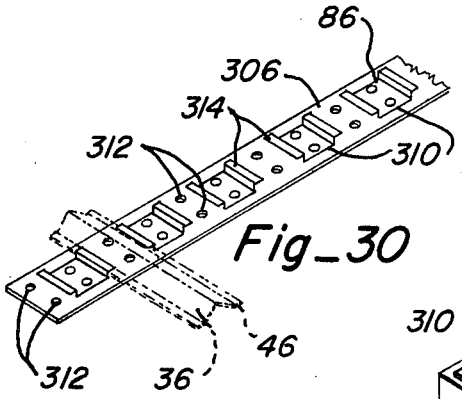
Figure 31:
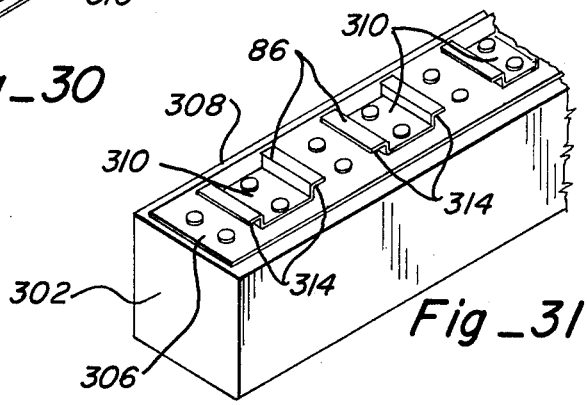
Figure 32:
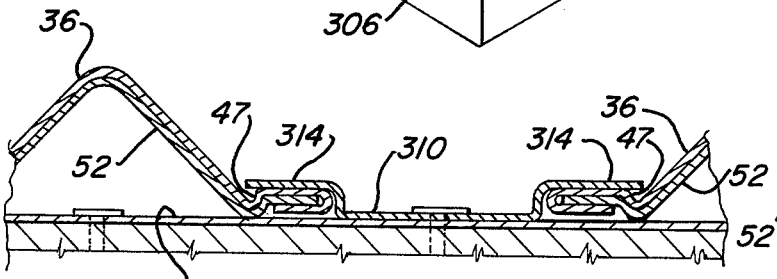
Figure 33:
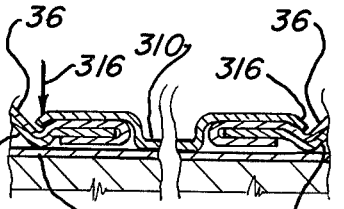
Figure 34:
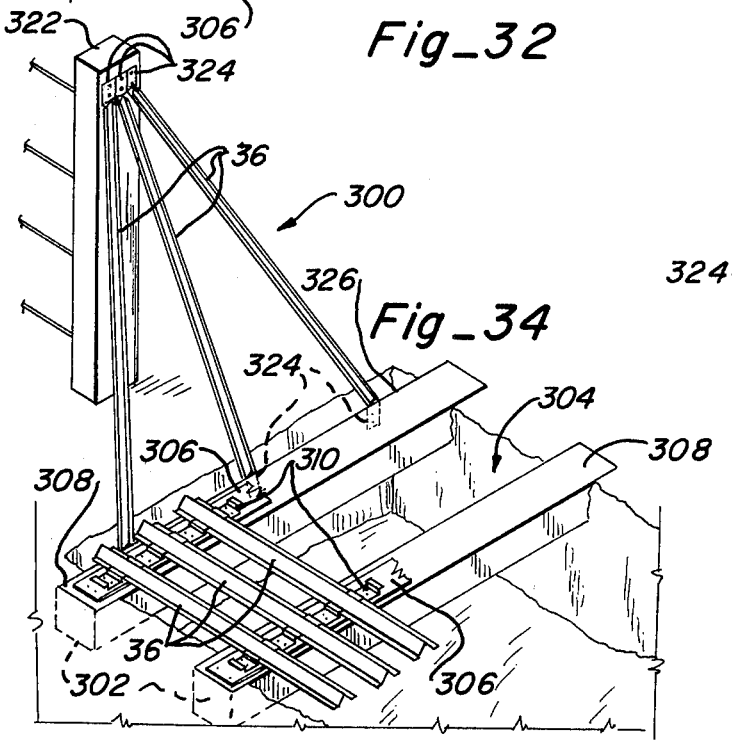
Figure 35:
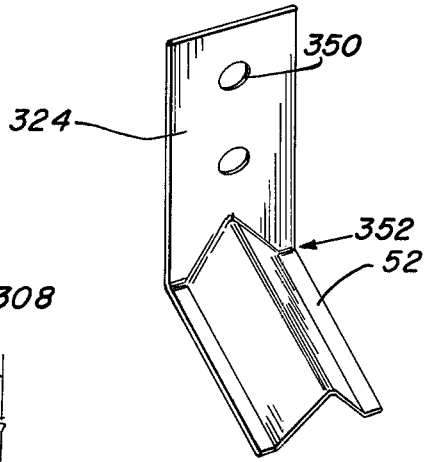

FIG. 18 pictorially illustrates the numerous applications and uses of the modular anchors and stays of the present invention as it pertains to repairing and supporting existing conventional fencing systems comprised of wood support posts and innerconnecting strands of wire barrier;

FIG. 19 is a front perspective view of an anchor-spike of the present invention for distributing weed killer or the like;

FIG. 20 is pictorial view illustrating the use of the anchors and stays of the present invention for repairing a snow fence;

FIG. 21 is a planar side view of an angle support stay of the present invention showing two positions used for bracing;

FIG. 22 is a pictorial illustration showing a rail fence constructed from components of the fencing system of the present invention;

FIG. 23 is a fragmentary representation showing the details of the stay of the present invention used as a protective shield over a guy-wire;

FIG. 24 is a perspective view of a nail extender of the present invention for use in rail fences;

FIG. 25 is a perspective view of an anchor-extender of the present invention;

FIG. 26 is an exploded perspective of a barricade stay, an extender, and a stay of the present invention;

FIG. 27 is a side planar view of a barricade of the present invention;

FIG. 28 is a partial perspective view showing the use of a sign support stay of the present invention;

FIG. 29 is a perspective view of a cattle guard constructed from components of the present invention;

FIG. 30 is a pictorial representation of a nail strip containing a plurality of anchors connected thereto;

FIG. 31 is a partial perspective view of the nail strip of FIG. 30 mounted on a railroad tie;

FIG. 32 is a cross-section of the nail strip of FIG. 30 interconnected with a stay of the present invention;

FIG. 33 is a cross-section of the nail strip of FIG. 32 with the flange end of the anchor permanently attached to the stay;

FIG. 34 is a partial perspective view showing the details of the cattle guard of the present invention; and FIG. 35 is a pictorial representation of a nail extender of the present invention for use in cattle guards.

DESCRIPTION

FIGS. 1 through 3 illustrates one aspect of the present invention as it is utilized to mount a sign 10 on a conventional fencing system 11 comprising two barbed wire barriers 12 stretched between two wooden fence posts 14 and mounted thereon by staples 16. The sign 10 as shown in FIG. 1, is of rectangular shape wherein clips 18 of the present invention are stamped out of the metal portion 20 and wrapped around the wire 12. The sign 10, therefore, is of one piece construction requiring no additional parts for mounting onto the fence.

Each clip 18 of the present invention, as shown in FIG. 2, is integral with the metal 20 of sign 10 at one end and the other end of the clip 18 is of generally triangular shape being stamped out of metal 20 and being disposed a slight distance away from the surface of the metal 20. It is evident, that by having the stamped clip 18 disposed away from the metal surface 20 of the sign 10, the clip 18 can readily be grasped by a pliars or the like and moved rapidly over the wire and crimped into a clamped position 22 as shown in FIG. 3 for a chicken wire barrier 24. The clip 18 has a first angular portion 27 integral with the metal 20 terminating at the mid-section 23 of the clip at which region the pointed end 25 of the clip 18 lays in substantially the same plane as the metal surface 20. The clamped clip 22 substantially encircles the barrier surface at a region substantially located in the mid-section of the clip 18. The pointed end 25 of the clip 18 undergoes a reverse bend in the clamped position 22 and lays in the same plane as the attached end 27 of the clip 18. Due to the almost complete encirclement of the barrier surface and the reverse bend of the pointed end 25, the clamp clip 22 will maintain its grip to the barrier even in such adverse weather conditions as high, gusting winds.

An alternate method of clamping the clip to a barrier is shown in FIGS. 2 and 3. In this method, the barrier 12 is placed between the metal surface 20 of sign 10 and the protruding clip 18. The pointed end 25 of the clip 18 is clamped over the barrier which in FIG. 2 is barbed wire 12, and through the opening 26 toward the attached end 27 of the clip 18. FIG. 3 shows the clamp position 29 of the clip 18 for a barrier of plain wire 28. The mid-section of the clip 18 substantially encircles the barrier 28 with the pointed end 25 of the clip 18 laying in the same plane as the attached end 29 of the clip 18.

Figure 4:
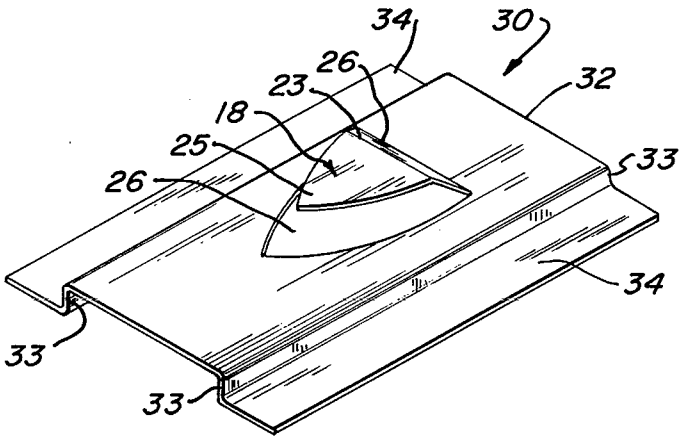
FIG. 4 is an enlarged full perspective view of an anchor of the present invention that contains a clip of the present invention.

The anchor 30 of the present invention whose use will be hereinafter described is shown in FIG. 4 to include the above described clip 18 centrally disposed on a raised mid-section 32 of horizontal cross-section. The clip 18 is aligned so that the pointed end 25 and the affixed end 27 are longitudinal with the longitudinal direction of the raised mid-section 32. The clip 18 angularly extends upwardly from the affixed end 27 to a center region 23 where the clip 18 is creased so that the clip from center region 23 to the pointed end 25 is oriented in a horizontal plane. The anchor 30 further comprises two vertical members 33 and two horizontal flange opposing edges 34 which due to the presence of the vertical members 33 are disposed at a distance below the raised mid-section 32. The anchor 30 is of generally rectangular configuration and can be affixed to the barriers of FIGS. 1 through 3 in the same manner as described for the sign 10. The anchor 30 can be formed from sheet metal or the like with the clip 18 being stamped therefrom. The anchor 30 and clip 18 are preferably of integral construction in order to minimize cost.

Figure 5:
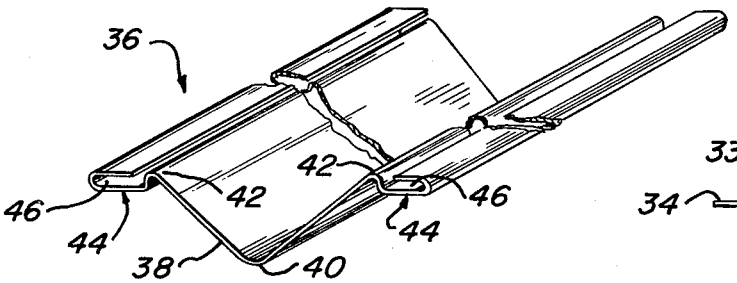
FIG. 5 illustrates an enlarged segmented end perspective view of a stay of the present invention.

The anchor 30 is designed to slide into the stay 36 shown in FIG. 5. The stay 36 has a downwardly protruding triangular shaped mid-section 38 having a rigid center upwardly opening rib 40 and two opposing end downwardly opening ribs 42. The edge ribs 42 are integral with horizontal opposing flanges 44 shaped to define open inwardly directed opposing channels 46. The stay 36 can be of any length, as will be hereinafter further discussed, and the center rib 40, the two opposing ribs 42, and the two opposing flanges 44 run the entire length of the stay 36. The two opposing horizontal flange edges 34 of the anchor 30 as shown in FIG. 4 are designed to slidably engage the formed opposing open channels 46 of the stay 36. The engagement of the anchor 30 with the stay 36 will now be discussed by reference to FIGS. 6 through 9.

Figure 6:
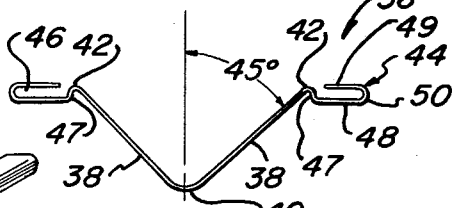
FIG. 6 is an end planar view of the stay of FIG. 5.

In FIG. 6 the cross-section of stay 36 is shown to include the center rib 40 having linearly upwardly extending sides 38 disposed at a 45° angle from vertical and terminating at the opposing edge ribs 42. The side of the edge rib 42 integral with side 38 also forms a 45° angle from vertical. The remaining side 47 is vertically oriented and merges with the bottom portion 48 of flange 44 on each side. The bottom portion 48 is disposed in a 90° relationship to side 47 and is integral with the upper portion 49 of flange 44 that is formed by a 360° bend 50. The upper flange portion 49 extends towards the edge rib 42 and terminates at a point in close parallel spaced relation thereto. It is to be understood, that the stay 36 with the various angular representations as shown in FIG. 6 is integrally formed from a material like, for example, sheet metal in order to minimize manufacturing costs.

Figure 7:
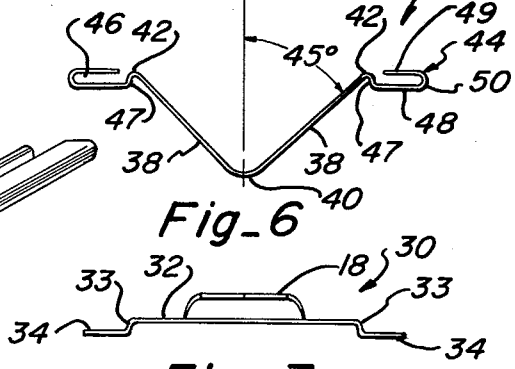
FIG. 7 is a planar end view of the anchor of FIG. 4.

FIG. 7 illustrates the cross-section of anchor 30 to include clip 18. As previously mentioned, the raised mid-section 32 is integral with the opposing downwardly extending vertical members 33 which, in turn, are integral with the opposing outwardly extending flanges 34. The angle between vertical members 33 and flange surfaces 34 is preferably 90° and the angle between vertical members 33 and the mid-section 32 is, also, preferably 90°.

Figure 8:
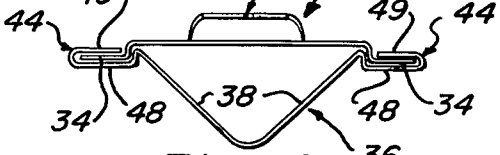
FIG. 8 is a planar end view of the anchor of FIG. 4 slideably positioned into the stay of FIG. 5.
Figure 9:
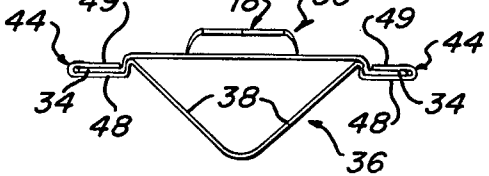
FIG. 9 is a planar end view of FIG. 8 with the stay permanently crimped to the anchor.

The anchor 30 slidably engages the stay 36 by the insertion of flanges 34 into open ends of the channels 46, as shown in FIG. 8. The horizontal distance between the opposing vertical members 33 of anchor 30 is slightly greater than the horizontal distance between the vertical sides 47 of the opposing edge ribs 42 of stay 36. Such a configuration enables the anchor 30 to firmly engage the outer surface of the edge ribs 42 of the stay 36. The anchor 30 can be permanently affixed to the stay 36, as shown in FIG. 9 by crimping the upper portion 49 towards the lower portion 48 of the opposing flanges 44. This crimping causes the anchor 30 to firmly engage the inner surfaces of the channels 46 and the outer surfaces of the vertical sides 47 of ribs 42. The upper portions 49 of the opposing flanges 44 substantially abut the outer surfaces of vertical members 33 at a point where members 33 merge with the opposing flanges 34. The resulting engagement as shown in FIG. 9 provides a rigid structure of triangular cross-section with the support rib 40 and opposing edge ribs 42 providing substantial support for the engaged relationship. The vertical engagement of members 33 with the opposing ribs 42 and the close relationships of the horizontal flanges 34 with channels 46 effectuate an extremely rigid interconnection that will be difficult to loosen even under such adverse circumstances as gusting high winds.

Figure 10:
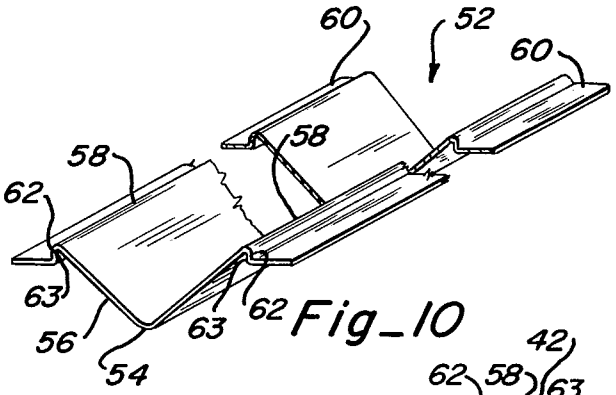
FIG. 10 is a segmented perspective view of an extender of the present invention.
Figure 11:
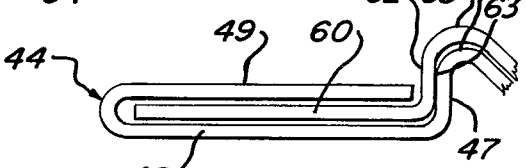
FIG. 11 is a partial planar end view of an extender similar to that of FIG. 10 engaging the inwardly directed channels of the horizontal side flanges of a stay similar to that shown in FIG. 5.
Figure 12:
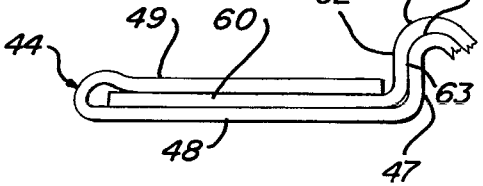
FIG. 12 is similar to FIG. 11 and illustrates the extender being crimped into position.

An extender 52 of the present invention is shown in FIG. 10 to have a central upwardly opening rib 54 having upwardly extending linear sides 56 extending therefrom to two opposing downwardly opening edge ribs 58 integrally connected to diametrically opposed horizontal flange edges 60. The linear side members 56 extend from the center rib 54 at an angle of preferably 45° from vertical to the center portion of ribs 58. The outer sides 62 of ribs 58 extend vertically from the center rib 58 downwardly in perpendicular engagement with the horizontal flange edges 60. The distance between the inner surfaces 63 of the vertical sides 62 is slightly greater than the distance between the outer surface of sides 47 of ribs 42 of the stay 36. The extenders 52 are designed to slidably engage the stay 36 through the insertion of the horizontal edges 60 into the open opposing channels 46 of the stay 36. When the extender 52 slideably engages the stay 36, the outer surfaces of the central rib 54 and linear sides 56 engage the inner surfaces of rib 40 and linear sides 38 of the stay 36. In addition, the under surface 63 of side ribs 62 of the extender 52 engage the outer surfaces of sides 47 of ribs 42 of the stay 36. This latter engagement is shown in FIG. 11. To permanently mount the extender 52 within a stay 36 the upper portions 49 of channels 46 are crimped downwardly toward the bottom portions 48 of the stay 36 thereby causing the inner surfaces of channel 46 to completely engage the surfaces of the flange edges 60 of the extender 52. As will become apparent in the ensuing discussion, extenders 52 may be used to further support stays 36 or to provide a means of connecting one stay 36 to another stay 36 as will be discussed later.

Figure 16:
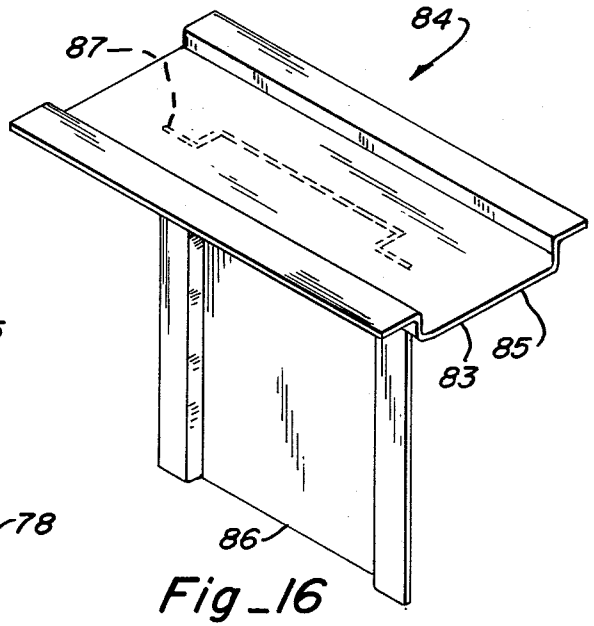
FIG. 16 is a perspective view of two anchors affixed in perpendicular relationship to each other.
Figure 15:
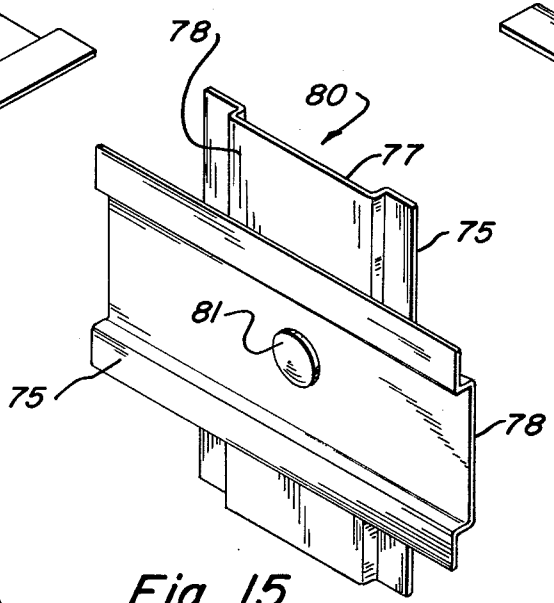
FIG. 15 is a perspective view of two anchors pivotally interconnected on corresponding raised mid-sections of each anchor.
Figure 13:
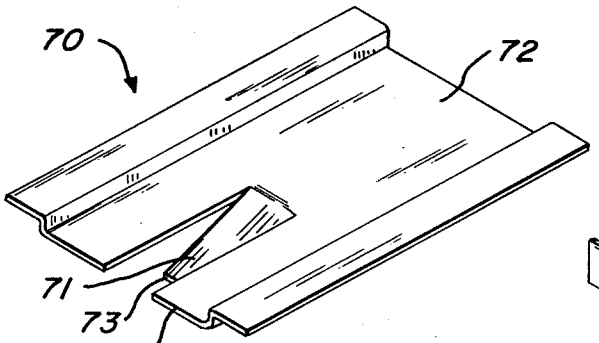
FIG. 13 is a perspective view of an anchor having an end clip thereon.
Figure 14:
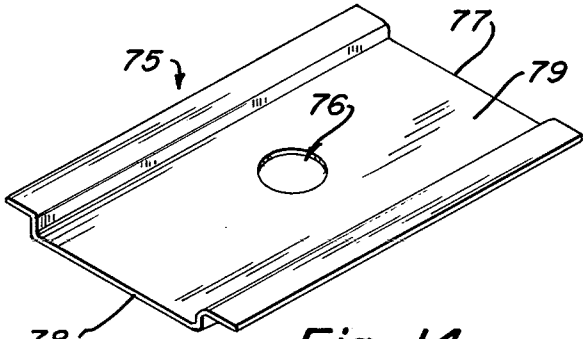
FIG. 14 is a perspective view of an anchor having a hole clip formed therein.

FIGS. 13 through 17 illustrate a variety of anchors of the present invention. FIG. 13 illustrates an edge clip anchor 70 wherein a protruding lip 71 is stamped from the horizontal raised mid-section 72 so that the end 73 of the lip protrudes away from the edge 74 of the mid-section 72. The protruding lip 71 can be crimped and clamped around a barrier in the same manner as was discussed for the clip 18 in FIGS. 1 through 3. The hole clip anchor 75 is shown in FIG. 14 to have a centrally disposed hole formed in the center of the raised mid-section 77. The hole clip anchor is used to attach the anchor 75 to a wooden post by driving a nail whose head is of a greater diameter then the diameter of the hole 76 through the hole and to the post. In such an arrangement, the outer surface 78 of the raised mid-section 77 would firmly abut the outer surface of the wood post with the head of the nail abutting the inner surface 79. In like manner, a bolt or similar affixing device may be utilized through hole 76. A pivotal dual anchor 80 is shown in FIG. 15 to include two hole anchors 75 interconnected on the outer surfaces 78 of the raised mid portions 77. Pivotally interconnecting the two anchors 75 is a rivet 81 or the like. It is to be understood that the pivotal dual anchor 80 may be made in any permanent angular relationship by firmly attaching the two anchors 75 together. FIG. 16 illustrates a T dual anchor 84 wherein identical anchors 85 and 86 are attached in the following manner. The outer surface 83 of the raised mid portion of the first anchor 85 is welded or braised to the top edge 87 of the second anchor 86. Anchor 86 is perpendicularly arranged to the surface 83 and is centrally disposed in the longitudinal direction of anchor 85. It is to be understood that the various anchors disclosed in FIGS. 13 through 16 are of the same physical construction as that of the anchor 30 shown in FIG. 4.

Figure 17:
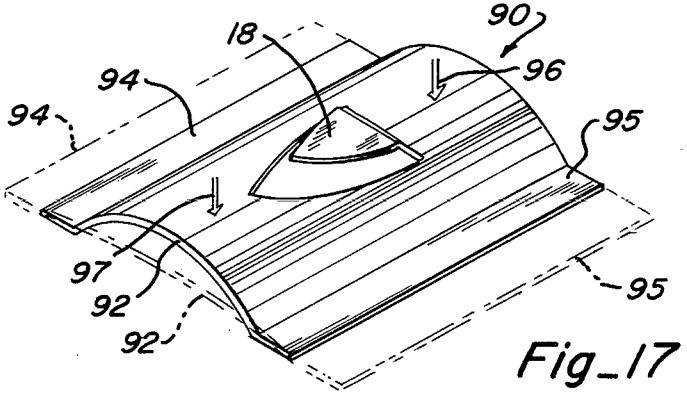
FIG. 17 is a perspective view of a front insertable anchor having an arcuate mid-section.

A front insertable anchor 90 of the present invention is shown in FIG. 17 to include a mid-section 92 of arcuate cross-section with parallel opposing side flanges 94 and 95. Disposed in the center of the arcuate mid-section 92 and oriented longitudinally with the side flanges 94 and 95 is a clip 18 of the present invention. The front insertable anchor 90 can be inserted into a stay 36 by first inserting flange 94 into one of the inwardly directed channels 46 of the stay 36 and then by inserting the remaining flange 95 into the remaining inwardly directed channel 46 on the stay 36. With both side flanges 94 and 95 inserted into the inwardly directed channels 46 of stay 36 sharp hammer blows at points 96 and 97 will flatten the anchor 90 into position as shown in the dotted line representation of FIG. 17. The front insertable anchor 90 finds application in situations where anchors 30 have been slideably disposed into a stay 36 and permanently affixed thereto by crimping. At a later time it becomes desirable to add a strand of wire, for example, between two existing wires connected to a stay 36 by anchors 30. By using a front insertable anchor 90, the additional strand of wire disposed between two pre-existing strands of wire may be rapidly provided.

A variety of different uses for the anchors and stays of the present invention are shown in FIG. 18. Conventional wooden posts 100 and bare wire barriers 102 forming a conventional fencing system is disclosed. A sagging barrier wire 103 is shown in FIG. 18 to which is attached an anchor 30 of the present invention. Also attached below the sagging wire 103 are two additional anchors 30 in vertical alignment thereof. These anchors are clamped to the wire barriers 131 in a manner previously discussed. A stay 36 of appropriate length is now slid over each anchor 30 and clamped thereto. The final positioning of the stay would appear as shown for the anchor and stay arrangement 105. The anchor and stay arrangement 106 is similar to the anchor and stay arrangement 105 but for the addition of an anchor 86 to which is welded or attached in a conventional fashion a stake 107. The anchor and stay arrangement 106 is used to repair existing fence systems that require additional ground support.

The anchor and stay arrangement 108 is a further modification of the anchor and stay arrangement 106 and includes a hollow stake 110, as shown in FIG. 19, for transmitting into the ground as graphically shown by arrows 112 weed killer or the like which is stored in the hollow cavity 114 formed between an extender portion 115, absent the opposing flanges 60, and a plain anchor 86. The extender portion 115 is welded or affixed to the anchor 86. The hollow stake 110 is welded or affixed in a conventional manner to the plain anchor 86 and extender 115. The anchor and stay system of 108 effectively kills weeds and prevents the growth of future weeds along the fence line. The weed killer stored in cavity 114 is dispersed whenever rain water flows down the stay 36.

An additional strand of wire barrier 120 can be added to the conventional fencing system by the anchor and stay arrangement 122 shown in FIG. 18. Clip anchors 30 are used to connect a stay 36 having an upwardly extending portion 124 to the conventional fence. The additional strand of wire barrier 120 is then attached to the extending portions 124 of stay 36 with the clip anchors 30 of the present invention. To lend further support to the extension barrier 120, an additional stay 36 can be mounted to the wooden post 100 by use of a hole anchor 75 which is attached by a nail, not shown.

It is to be understood that, in a similar manner, additional wire strands 120 may be rapidly and conveniently added to an existing fence structure while at the same time providing additional support for the existing wire barriers 102 of the fence.

A sign 130 can be attached to a wire barrier 102 of the conventional fence shown in FIG. 18 by use of a stay 132 welded or permanently affixed to sign 130 along the center rib 40 and by using anchors 134 having the clips 18 arranged perpendicular to the longitudinal length of each anchor. In this manner, the anchors 134 are attached to the wire barrier 102 and clipped into position, whereupon the sign 130 attached to stay 132 can either be permanently or temporarily mounted to anchors 134.

Wood snow fences 140, shown in FIG. 20, deteriorate when slats 142 break or become missing. Once a wooden slat breaks or becomes missing the strength and usefulness of the snow fence 140 quickly deteriorates. Such snow fences 140 can be easily repaired by attaching clip anchors 30 to the interconnecting wires 144 and by sliding a stay 36 of the present invention over the attached anchors. The stay 36 is then clamped to each anchor to provide a completely repaired snow fence 140 of usually increased strength and durability.

A common problem of repair for existing fencing systems is that of repairing leaning fence posts, wire and other barriers. An anchor and stay arrangement 150 shown in FIGS. 18 and 21 solves the above described problem by providing anchors 30 clipped to the leaning wire barriers and inserted into a stay 36 which is pivotally connected by a flex extender 152 to an earth support 154. The configuration of the flex extender will be discussed later. The earth support 154 comprises a generally long rectangular configuration having two opposing inwardly directing channels 156. Permanently affixed by welding or other means to the under surface of the earth support 154 are stakes 158. Angularly disposed between the vertical stay 36 and the rear portion 160 of the earth support 154 is an angle stay 36 which is coupled to stay 36 by a flexing member 152 and further slideably engaging the inwardly directed channels 156 by connection to a slide plate 166. The anchor 30 is first connected to the sagging and leaning wire 103 and clamped thereto. Other anchors 30 are attached to the remaining wire barriers 131. The anchors 30 are now slid into engagement with the vertical stay 36 and firmly crimped into the desired position. The vertical stay 36 is now in the tilted position as represented by the dotted lines of FIG. 21. The slide plate 166 connected to the angle stay 36 is now slid towards the stay 36 to tilt the stay 36 into the vertical or upright position as shown in FIG. 21. The flange portions of the inwardly directed channels 156 are now crimped onto the slide plate 166. The earth support 154 is now inserted into the desired ground orientation by driving the entire anchor and stay system 154 into the ground so that the stakes 158 firmly engage therewith.

The fencing system of the present invention can be further utilized in building a rail fence of the type shown, for example, in FIG. 22. A wooden post 170 is utilized to provide corner strength and the post 170 may be further supported by a guide wire 172 driven into the ground in a conventional fashion by a stake 174. A stay 36 of the present invention may be disposed over the guide wire so that the guide wire 172 lies in the channel defined by the inner surface of the rib 40. Plain anchors 86 can be inserted at a plurality of places in stay 36 and clamped in place to provide a permanent attachment of the stay 36 to the support wire 172 thereby providing an effective protective shield to ward off animals or the like from straying near the support wire as shown in FIG. 23.

Anchor and stay arrangements 106 shown in FIG. 18 are utilized in place of wooden posts or the like to provide appropriately spaced vertical supports to the rail fence of the present invention shown in FIG. 22. Pivot anchors 80 are permanently clamped at predetermined vertical distances on the vertical stay 36 and horizontal stays 36 are slideably disposed over the horizontal members of the pivotal anchors 80. In this case, the pivotal stays 80, as previously mentioned, are preferably permanently affixed in a perpendicular relationship. The details of an extender plate 174 are shown in FIG. 24 to include an attachment plate 176 having formed therein a plurality of attachment holes 178 and extending perpendicularly therefrom an extender portion 52 which is permanently mounted or affixed thereto. These extender attachments 174 are mounted onto the wooden posts 170 with bolts or nails 171 or the like at the appropriate predetermined vertical distances. The horizontal stays 36 slideably engage the protruding extender portions 52 and in final mounting position are permanently crimped thereto. Horizontal stays 36 can also be rapidly interconnected with extenders 52 to couple one stay to another. Should the vertical stay and anchor arrangements 106 require further support, an angular stay 36 may be provided through use of pivotal anchors 80 and a ground stake 107. An upper stay 36 with the rib 40 upwardly extending can be used to top off the rail fence shown in FIG. 22 by affixing a hole anchor 79 with a nail 181 to post 170. An extender anchor 180 is also provided to attach the upper stay 36 to the support anchor and stay arrangement 106. The details of the extender anchor 180 are shown in FIG. 25 to include a plain anchor 86 to which is welded or permanently mounted thereon an extender portion 52. By use of the above components, a rail fence can be quickly constructed that is both durable and long lasting.

A barricade stay 200 is shown in FIG. 26 to comprise a predetermined length of stay material 36 bent at a mid-section point 202. The barricade stay 200 can be attached to a normal stay 36 through use of an extender 52 or to a wooden post 204 as shown in FIG. 27 through use of a hole anchor 75. The barricade stay 200 as shown in FIGS. 26 and 27 is used to support a plurality of wire barriers 102 connected to the barricade stay 200 by means of clip anchors 30. It can be readily observed that barricades can be provided for existing fences through use of techniques previously described for the anchor and stay system 122 shown in FIG. 18 and the barricade stays 200 of FIGS. 26 and 27 wherein an extra strand of wire barrier can be added to a pre-existing fence. The barricade stay 200 can be designed to be symmetrical about the center point 202 so that either end of the barricade 200 can be used for the lower point of attachment.

FIG. 28 details the use of a hole anchor 75 affixed to a post 210 over which is slideably disposed a modified stay 212 composed of two inwardly directed channels 214 and a flat interconnecting section 216 disposed therebetween, the center rib 40 of a normal stay 36 being eliminated. Centrally disposed on the mid-section 216 of modified stay 212 is an angle connector 218 which supports a sign 200. The sign 220 can be rapidly attached to an existing post in this manner and may be temporarily or permanently affixed to the hole stay 75.

A cattle guard 300, shown in FIGS. 29–35, can be easily constructed from the components of the present invention. The cattle guard 300 comprises a plurality of railroad ties 302 disposed over an open pit 304. On the upper surface 308 of each railroad tie 302 is nailed an anchor strip 306. The anchor strip 306 contains a plurality of plain anchors 86 which are welded or permanently affixed to the strip 306 with the raised mid-portion 310 of each member 86 abutting the nail strip 306 and with the longitudinal length of the anchors 86 being perpendicularly oriented to the longitudinal length of the strip 306. A plurality of nail holes 312 are formed in the strip 306 for attachment of the strip 306 to the upper surface 308 of the railroad tie 302 as shown in FIG. 31. Anchors 86 are horizontally disposed so that the outer flange edges 314 overlap the outer flange edges 46 of a stay 36 with rib 40 upwardly directed of the present invention as shown by the dotted lines in FIG. 30. In construction of the cattle guard 300 the anchor strips 306 are nailed onto the upper surface 308 of each railroad tie 302 so that corresponding anchors on each railroad tie are in alignment with each other. Stays 36 further have disposed therein a comparable length of extender material 52 and the assembly of stay 36 and extender 52 are positioned between each anchor 86 on the anchor strip 306. FIG. 32 illustrates the manner in which the anchors 86 are attached to the stays 36 containing extenders 52 therein. After the stays 36 and extenders 52 are slid underneath the flange portions 314 a hammer blow is directed at point 316 as indicated by the arrow in FIG. 33 to bend the extreme outer edge of the flange 314 over the vertical wall 47 of parallel opposing ribs 42 of each stay 36. End posts 322 are provided at opposing ends of the cattle guard 300 and have flex extenders 152, shown in FIG. 35, attached thereto. Each flex extender comprises an upper rectangular plate 324 having means 350, e.g. formed nail holes for use on a wood post, for attachment and a lower extender portion 52 for attachment to a stay 36. The junctor 352 is designed in a conventional fashion to permit a limited degree of flexing. Flex extenders 152 are also attached to the vertical edges 326 of the end railroad ties 302. Stays 36 are now interconnected at appropriate angles between the railroad tie 302 and the vertical end posts 322 in a manner previously discussed by attachment to the extender portion 52 and crimping thereof.

The preferred embodiment of the present invention is the provision of a plurality of anchors having a common mating surface with any of a plurality of stays and the provision of a plurality of extenders having a common mating surface with any of a plurality of stays.

While other certain illustrative embodiments of the present invention have been shown in the drawings and described above in considerable detail, it should be understood that there is no intention to limit the invention to the specific forms disclosed. On the contrary, the intention is to cover all modifications, alternative constructions, equivalents and uses following within the spirit and scope of the invention as expressed in the appended claims.

What I claim is:

1. A fencing system for supporting a plurality of barriers comprising:

a plurality of anchors for connecting to said barriers, each of said anchors comprising:

a. a mid-section portion of rectangular configuration, b. substantially vertical side members on opposing longitudinal sides of said mid-section portion extending downwardly from said sides, c. means disposed on the upper surface of said mid-section portion for connecting said anchor to one of said barriers, and d. substantially horizontal opposing edges in parallel spaced relation extending outwardly from the bottom of each of said side members; and a plurality of stays for providing support to said barriers, each of said stays comprising:

a. a longitudinal member having a mid-section portion of angular cross-section, said aforesaid member having downwardly extending sides convergent into a center rib, b. each of said convergent sides terminating at the end opposite said rib into a reverse bend, c. substantially vertical side members extending downwardly from each of said reverse bends toward said rib, and d. inwardly directed substantially horizontal open channels extending from the bottom end of said vertical side members, said open channels being receptive of said edges for engaging said anchor.

* * * * *